US009126311B2

(12) United States Patent
Bednar et al.

(10) Patent No.: US 9,126,311 B2
(45) Date of Patent: Sep. 8, 2015

(54) ARROW EXTRACTOR

(71) Applicant: Hunter's Manufacturing Company, Inc., Suffield, OH (US)

(72) Inventors: Richard L. Bednar, Munroe Falls, OH (US); Michael J. Shaffer, Mogadore, OH (US); Jacob A. Hout, Akron, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 45 days.

(21) Appl. No.: 13/718,010

(22) Filed: Dec. 18, 2012

(65) Prior Publication Data

US 2013/0175817 A1 Jul. 11, 2013

Related U.S. Application Data

(60) Provisional application No. 61/584,342, filed on Jan. 9, 2012.

(51) Int. Cl.

| | |
|---|---|
| ***B25B 7/02*** | (2006.01) |
| ***F41B 5/14*** | (2006.01) |
| ***B25B 7/08*** | (2006.01) |

(52) U.S. Cl.
CPC ... *B25B 7/02* (2013.01); *B25B 7/08* (2013.01); *F41B 5/1465* (2013.01)

(58) Field of Classification Search
CPC ..... F41B 5/1465
USPC ..... 294/217, 118, 16, 902; 29/278; 81/416, 81/424.5, 423
See application file for complete search history.

(56) References Cited

U.S. PATENT DOCUMENTS

| | | | | | |
|---|---|---|---|---|---|
| 1,910,750 | A * | 5/1933 | Clark | 81/426.5 |
| 2,234,026 | A * | 3/1941 | Smith | 81/53.11 |
| 4,005,893 | A * | 2/1977 | Tash | 294/28 |
| 4,073,418 | A * | 2/1978 | Edson | 81/3.44 |
| 4,478,532 | A * | 10/1984 | Puro | 403/157 |
| 5,143,359 | A * | 9/1992 | Bush | 269/6 |
| 5,546,621 | A * | 8/1996 | Bulot | 7/138 |
| 5,730,033 | A * | 3/1998 | Mitrowski | 81/53.11 |
| 5,991,997 | A * | 11/1999 | Schley et al. | 29/426.5 |
| 6,854,776 | B2 * | 2/2005 | Downing | 294/215 |
| 7,234,219 | B2 * | 6/2007 | Deiter | 29/426.5 |
| 8,454,070 | B2 * | 6/2013 | Bierfreund | 294/217 |

* cited by examiner

*Primary Examiner* — Dean Kramer
(74) *Attorney, Agent, or Firm* — Emerson Thomson Bennett

(57) ABSTRACT

One or more techniques and/or systems are disclosed for an arrow extractor. The arrow extractor can comprise a first and a second elongated lever that are in rotatable engagement with each other. The respective elongated levers comprise a first end configured to be manipulated by a user, and a second end that comprises a tool configured to engage a first and second part of a gripper. The gripper comprises an elongated cavity that can be configured to grip the shaft of an arrow. The first tool and the second tool are engaged with the gripper, and when the user applies a grasping force to the first end of the respective levers, the grasping force may also applied to the gripper, thereby gripping the shaft of the arrow, which may then be extracted from an object using the levers.

19 Claims, 13 Drawing Sheets

ARROW EXTRACTOR

CROSS-REFERENCE TO RELATED APPLICATIONS

This application claims the benefit of U.S. Provisional Application No. 61/584,342, filed Jan. 9, 2012. All of the subject matter disclosed by U.S. Provisional Application No. 61/584,342 is hereby incorporated by reference into this application.

BACKGROUND

Bows and crossbows are used to fire arrows. Arrows fired from a bow or crossbow may strike an object and become embedded therein. Because of the energy imparted to an arrow upon firing, it is not uncommon for an arrow embedded in an object to be difficult to extract therefrom.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

Accordingly, among other things, one or more devices are disclosed for extracting an embedded arrow from an object.

In one implementation an arrow extractor can comprise a first elongated lever and a second elongated lever, which may be in rotatable engagement therewith. The first elongated lever can comprise a first end, which may be configured to be manipulated by a user, and a second end comprising a first tool. The first tool can be configured to engage a first part of a gripper, which can comprise an elongated cavity configured to grip the shaft of an arrow. The second elongated lever can comprise a first end that may be configured to be manipulated by the user and a second end comprising a second tool. The second tool can be configured to engage a second part of the gripper. The first tool and the second tool can be engaged with the gripper such that the user can apply a grasping force to the gripper by manipulating the first ends of the levers with respect to one another.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

DETAILED DESCRIPTION

Figure 1:
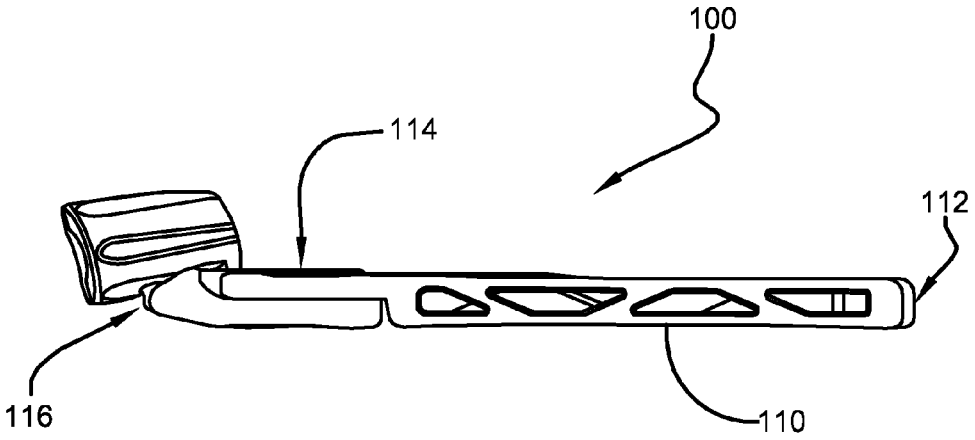
FIG. 1 is a component diagram illustrating a front orthogonal view of an example implementation of an arrow extractor.
Figure 2:
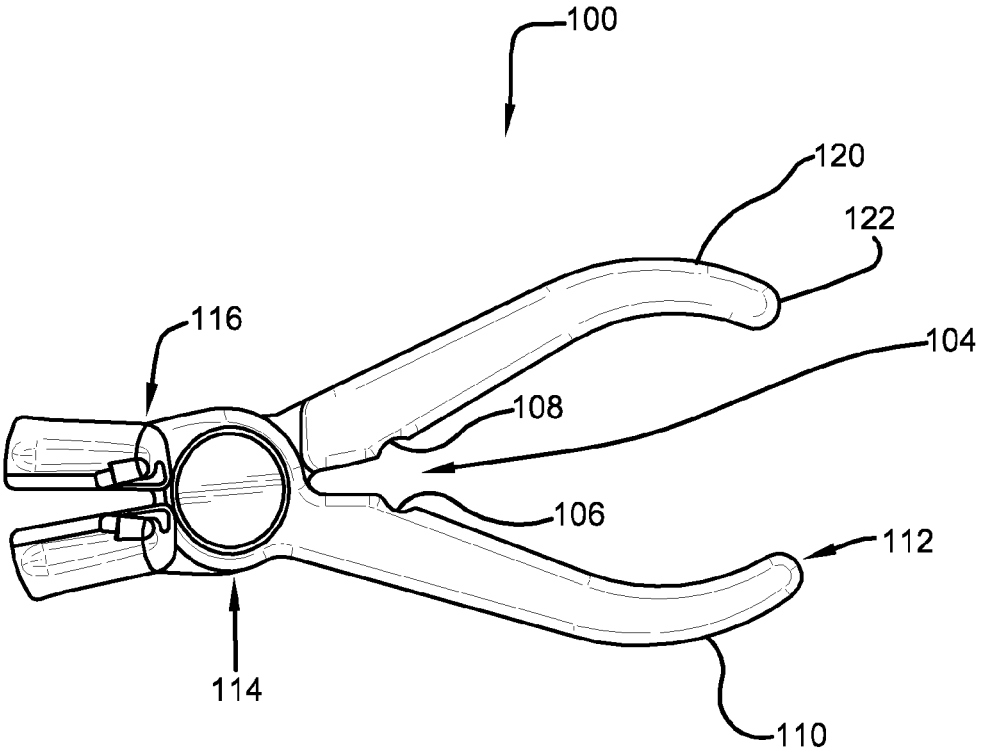
FIG. 2 is a component diagram illustrating a top orthogonal view of an example implementation of an arrow extractor.
Figure 3:
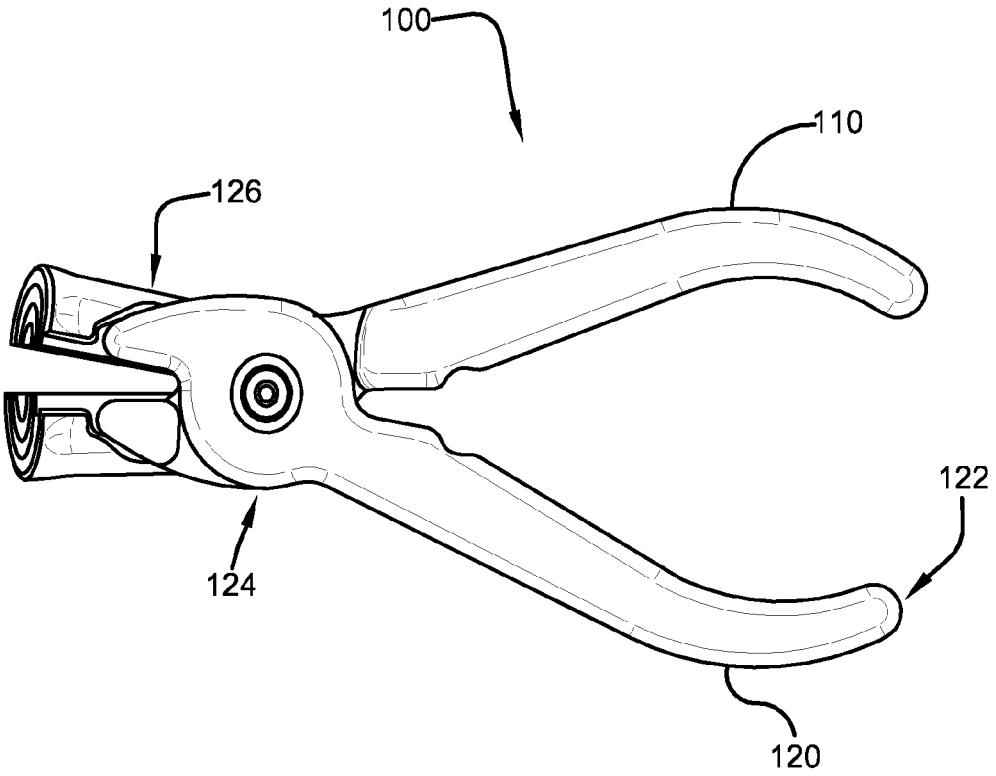
FIG. 3 is a component diagram illustrating a bottom orthogonal view of an example implementation of an arrow extractor.
Figure 4:
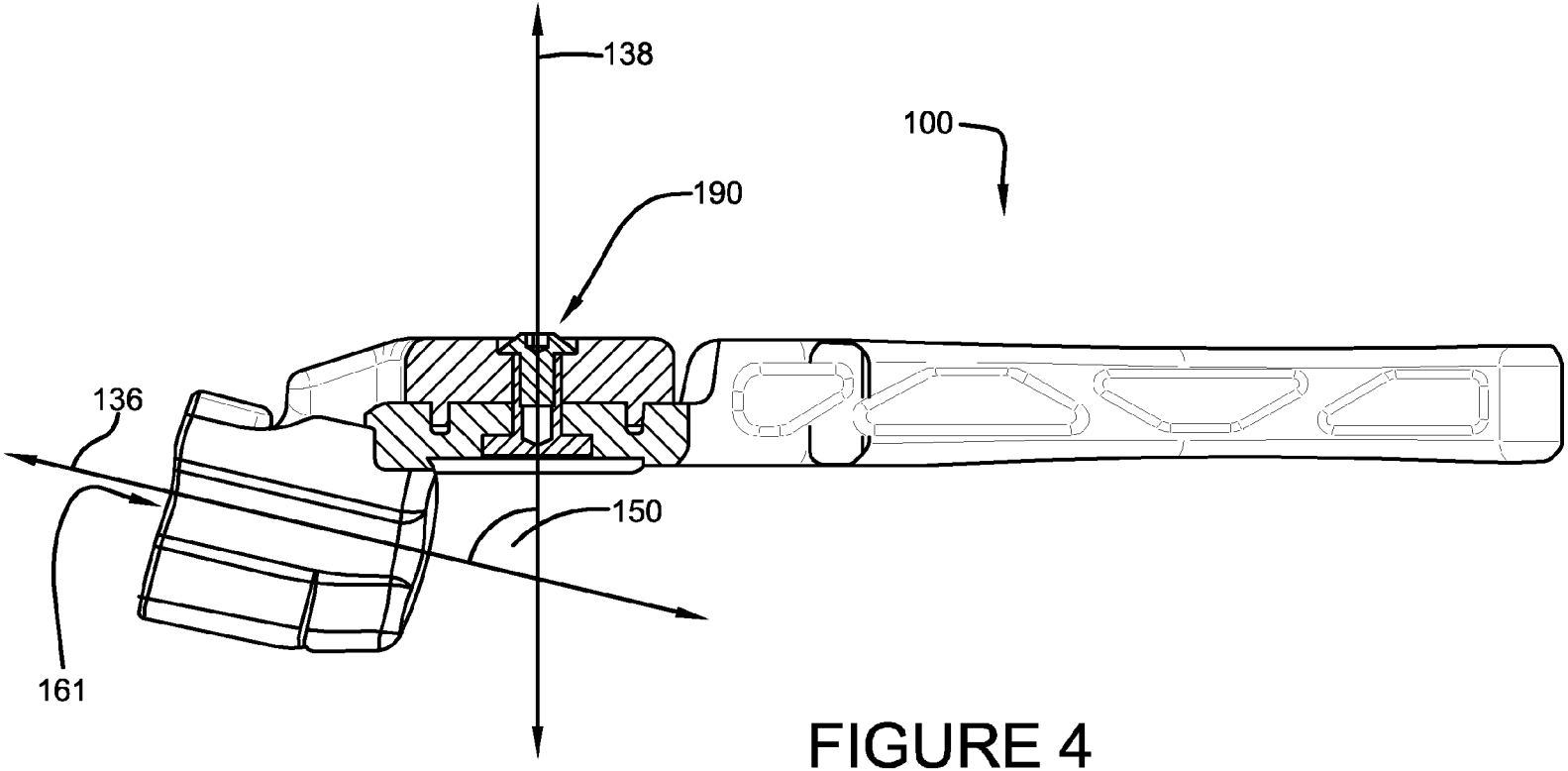
FIG. 4 is a component diagram illustrating a sectional view of an example implementation of an arrow extractor.
Figure 5:
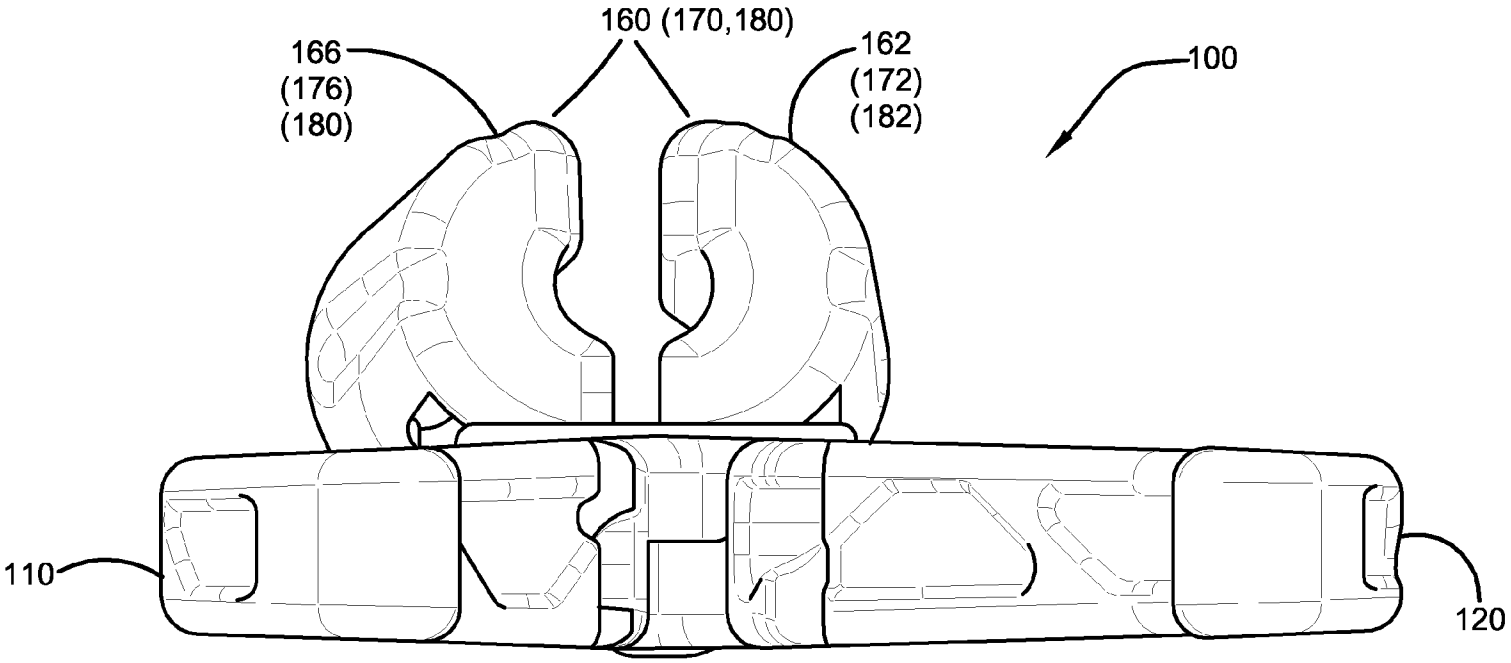
FIG. 5 is a component diagram illustrating a side orthogonal view of an example implementation of an arrow extractor.
Figure 6:
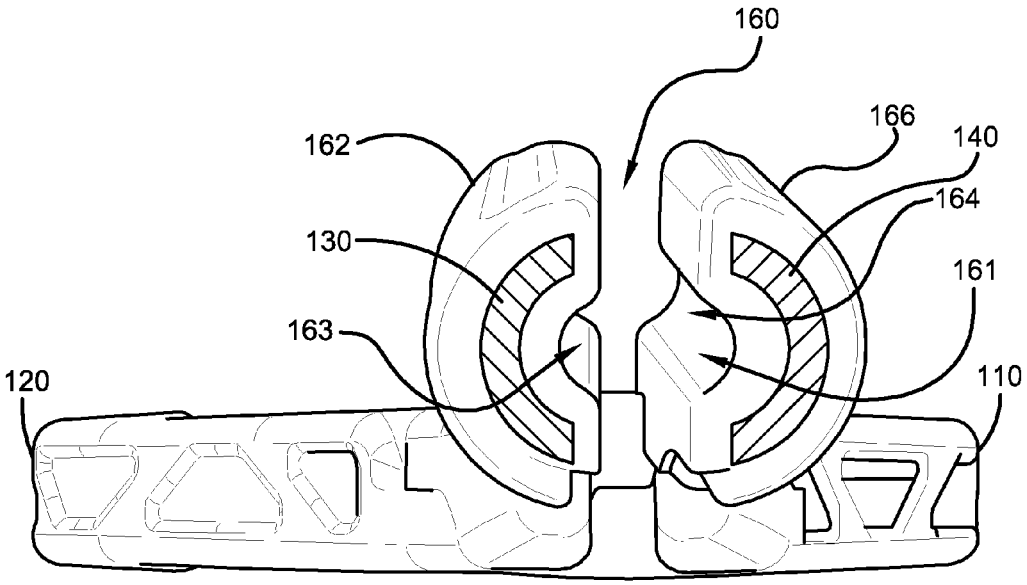
FIG. 6 is a component diagram illustrating a side orthogonal view of an example implementation of an arrow extractor.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

As provided herein, a device may be devised that may facilitate extraction of an embedded arrow from an object, such as a high-density archery target.

Referring now to FIGS. 1-16, shown is a first implementation of an arrow extractor 100. In one implementation (e.g., FIGS. 1-3, 8, and 9), the arrow extractor 100 comprises a first elongated lever 110 and a second elongated lever 120. The first elongated lever 110 comprises a first end 112, configured to be manipulated by a user, and a second end 116 comprising a first tool 130. The second elongated lever 120 is in rotational engagement with the first elongated lever 110. The second elongated lever 120 comprises a first end 122, configured to be manipulated by the user, and a second end 126 comprising a second tool 140. As used herein, unless otherwise noted, manipulation can mean being grasped, used, moved, pushed, pulled, or otherwise subjected to a force by hand.

In this implementation (e.g., in FIGS. 5, 6, 10 and 11), the first tool 130 is configured to engage a first part 162 (e.g., 172, 182) of a gripper 160 (e.g., 170, 180). Further, the second tool 140 is configured to engage a second part 166 (e.g., 176, 186) of the gripper 160. The gripper 160 (e.g., consisting of the first part 162 and the second part 166) comprises an elongated cavity 161 that is configured to grip the shaft of an arrow 200. Additionally, the first tool 130 and the second tool 140 are configured to apply a grasping force to the gripper 160 when the user manipulates the first elongated lever 110 with respect to the second elongated lever 120.

In one implementation (e.g., FIGS. 1-3, 4, and 7-9), the first elongated lever 110 and a second elongated lever 120 can be rotationally engaged at a first rotational engagement region 114 of the first lever 110 and a second rotational engagement region 124 of the second lever 120. In one implementation, the rotational engagement may be mechanically secured using mechanical components 192, 194, 196, and 198. As one example, the first rotational engagement region 114 of the first lever 110 and a second rotational engagement region 124 of the second lever 120 may be disposed at a location on the respective levers 110, 120 that provides a desired amount of grasping force to the respective tools 130, 140 (e.g., and subsequently the gripper 160) when the respective first ends 112, 122 of the levers 110, 120 are manipulated by the user.

In one implementation, the first lever 110 and the second lever 120 can be rotatably engaged with each other at their respective rotational engagement regions 114, 124. This engagement creates a scissor-like or plier-like arrangement, for example, that may permit a user to grasp the arrow extractor 100 and apply a grasping force to the first end 112 of the first lever 110, and/or to the first end 122 of the second lever 120, thereby applying a grasping force through the second ends 116, 126 of the levers 110, 120, through the tools 130, 140 engaged respectively thereto, through the gripper parts 162 and 166 engaged respectively thereto, and to an associated arrow 200 within the gripper 160.

As noted above, for example, the action of the grasping force transmission may also apply if the gripper 160 were replaced by an alternate gripper (not shown). In the first implementation of the arrow extractor 100, the grasping force applied by a user is substantially magnified by the mechanical advantage created by the relative placement of the rotational engagement regions 114, 124 with respect to the first end 112 of the first lever 110, the first end 122 of the second lever 120, the second end 116 of the first lever 110, and the second end 126 of the second lever 120. This magnification of the grasping force allows a user to firmly grasp an associated arrow 200 thereby improving the ease of extraction of the associated arrow 200 from an object in which it is embedded, and decreasing slippage of and/or damage to the associated arrow.

That is, for example, a lever's action (e.g., amount of force applied and amount of resulting force) may be determined by a location of a fulcrum on the lever. Further, in this example, the rotational engagement region 114, 124 of the respective levers can comprise the fulcrum when two levers are rotationally engaged. Therefore, in this example, moving the rotational engagement region toward the front of the levers (e.g., the second end) may increase the resulting force on the front of the lever (e.g., comprising the tools and gripper) when hand pressure is applied to the back end (e.g., first end) of the levers, and vice-versa.

Further, in one implementation (e.g., FIGS. 5, 6, 10, 11, and 16), the arrow extractor 100 may comprise one or more alternately interchangeable grippers 170, 180. As one example, the respective alternate grippers 170, 180 can be configured to grasp different sized arrow shafts, where the alternate grippers 170, 180 comprise a different size gripping area. In one implementation, the respective grippers 160, 170, 180 may be selectively removal from the arrow extractor. That is, for example, an arrow shaft comprising a larger diameter may not be effectively gripped by a first gripper (e.g., 160), due to a dimension of its corresponding elongated cavity (e.g., 161). In this example, the first gripper may be removed by the user, and a second gripper (e.g., 170), comprising an elongated cavity dimensioned to appropriately accommodate gripping of the arrow shaft, can be attached to the arrow extractor.

In one implementation, the first elongated lever 110 may be comprised of a long glass fiber (LGF) reinforced thermoplastic, such as Complet brand LGF thermoplastic urethane. As one example, the first elongated lever 110 may be formed by molding, casting, or otherwise forming the lever using a suitable process selected with good engineering judgment. Further in other implementations, the first elongated lever 110 may be comprised of polymers, metals, alloys, and/or other suitable materials selected with good engineering judgment. In one implementation, the first end 112 of the first elongated lever 110 can comprise an integrally formed first handle 113 that is configured to be manipulated by the user.

In one implementation, the second elongated lever 120 can also be comprised of a long glass fiber (LGF) reinforced thermoplastic, such as Complet brand LGF fiber-filled thermoplastic urethane. As one example, the second elongated lever 120 may be formed by molding, casting, or otherwise forming the lever using a suitable process selected with good engineering judgment. Further in other implementations, the second elongated lever 120 may be comprised of polymers, metals, alloys, and/or other suitable materials selected with good engineering judgment. In one implementation, the first end 122 of the second elongated lever 120 can comprise an integrally formed first handle 123 configured to be manipulated by the user.

As described above, the first tool 130 may be engaged with the second end 116 of the first lever 110. In one implementation, the first tool 130 can be integrally formed with the second end 116 of the first lever 110. For example, the first tool 130 may be integrally formed with the second end 116 of the first lever 110 by casting and/or molding them as a single integral component. In other implementations, the first tool 130 may be a separately formed component that can be engaged with the second end 116 of the first lever 110 by engaging means, comprising adhesives and/or mechanical fasteners.

In one implementation, the first tool 130 can be configured to selectively engage a first part 162, 172, 182 of a gripper 160, 170, 180, such that the first part 162, 172, 182 of the gripper 160, 170, 180 may be engaged with or disengaged from the first tool 130 at the selection of the user. The first tool 130 may be configured to selectively engage with any of a plurality of interchangeable gripper parts, for example, such that the first tool 130 may interchangably engage a first part 162 of a first gripper 160, the first part 172 of a second gripper 170, and/or, optionally, a first part 182 of a third gripper 180.

As described above, the second tool 140 may be engaged with the second end 126 of the second lever 120. In one implementation, the second tool 140 can be integrally formed with the second end 126 of the second lever 120. For example, the second tool 140 may be integrally formed with the second end 126 of the second lever 120 by casting and/or molding them as a single integral component. In other implementations, the second tool 140 may be a separately formed component that can be engaged with the second end 126 of the second lever 120 by engaging means, comprising adhesives and/or mechanical fasteners.

In one implementation, the second tool 140 can be configured to selectively engage a second part 166, 176, 186 of a gripper 160, 170, 180, such that the second part 166, 176, 186 of the gripper 160, 170, 180 may be engaged with or disengaged from the second tool 140 at the selection of the user. The second tool 140 may be configured to selectively engage with any of a plurality of interchangeable gripper parts, for example, such that the second tool 140 may interchangably engage a second part 166 of a first gripper 160, the second part 176 of a second gripper 170, and/or, optionally, a second part 186 of a third gripper 180.

In one implementation, the first tool 130 can be integral with the first part 162 of the gripper 160, and the second tool 140 can be integral with the second part 166 of the gripper 160. Further, in this implementation, the first tool 130 may be configured to be selectively removable from the second end 116 of the first elongated lever 110, and the second tool 140 may be configured to be selectively removable from the second end 126 of the second elongated lever 120. As one example, a first gripper (e.g., 160), integral with a first tool and second tool (e.g., 130 and 140), may be configured to grip the shaft of a first sized arrow, and a second gripper (e.g., 170), integral with another first and second tool, may be configured to grip the shaft of a second sized arrow. In this example, the first tool (e.g., 130) of the first gripper (e.g., 160) can be selectively removed and replaced with the first tool of the second gripper, and the second tool of the first gripper can be selectively removed and replaced with the second tool of the first gripper.

A gripper 160, 170, 180 may comprise a component of the arrow extractor that is configured to grasp the shaft of an arrow. The gripper 160, 170, 180 may comprise an elongated cavity 161 that is configured to fit around the shaft of the arrow, and to grip the shaft of the associated arrow, for example, with sufficient grasping force to allow the arrow to be extracted from a target (e.g., a high density target) by pulling on the first and second levers 110, 120. The gripper 160, 170, 180 may comprise disparate components, such as a first part 162, 172, 182 and a second part 166, 176, 186. The first part 162, 172, 182 can comprise a first portion of the elongated cavity 161 and the second part 166, 176, 186 can comprise a second portion (e.g., the remaining portion) of the elongated cavity 161.

In one implementation, where the gripper 160, 170, 180 comprises a first part 162, 172, 182 and a second part 166, 176, 186, the first part 162, 172, 182 may be engaged (e.g., selectively) with first tool 130 and the second part 166, 176, 186 may be engaged (e.g., selectively) with second tool 140. In one implementation, the elongated cavity 161 of the gripper 160, 170, 180 may comprise a substantially cylindrical shape, for example, configured to enclose a substantially cylindrically shaped shaft of an arrow 200. In other implementations, the elongated cavity 161 of the gripper 160, 170, 180 may comprise alternate shapes that are configured to enclose an alternately shaped arrow shafts, such as multi-sided polygon shapes (e.g., triangle, square, pentagon, octagon, etc.), star-shapes, oval shapes, etc.

In one implementation, the first part 162, 172, 182 can comprise substantially half of the gripper 160, 170, 180 and half of the elongated cavity 161, and the second part 166, 176, 186 can comprise substantially half of the gripper 160, 170, 180 and half of the elongated cavity 161. As one example, where the elongated cavity 161 comprises the substantially cylindrical shape, the first part 162 can comprise an elongated substantially semi-cylindrical groove 163, and the second part 166 can comprise an elongated substantially semi-cylindrical groove 164. In other implementations, the elongated cavity 161 may comprise an elliptical cross-section, a polygonal cross section, teeth, ribs, or other geometries.

It should be understood that a gripper 170, 180 other than gripper 160 may also be adapted to engage with the arrow extractor 100. Since a first associated arrow may have a different shaft size, diameter, or other shaft geometry than a second associated arrow, it may advantageous to provide one or more additional grippers 170, 180 other than gripper 160 and adapted to interchange with each other and gripper 160 such that a user may select a particular gripper 160, 170, 180 configured to extracting a particular associated arrow. In one implementation, a second gripper 170, 180 may be similar to gripper 160 in most respects, and therefore may be used to replace gripper 160 on the arrow extractor 100, excepting that the elongated cavity of the second gripper 170, 180 is larger than that of elongated cavity 161.

In one implementation, the first part 162, 172, 182 of the gripper 160, 170, 180 may be configured to engage the first tool 130 by sheathing at least a portion of the first tool 130 with the first part 162, 172, 182 of the gripper 160, 170, 180. Further, the second part 166, 176, 186 of the gripper 160, 170, 180 may be configured to engage the second tool 140 by sheathing at least a portion of the second tool 140 with the second part 166, 176, 186 of the gripper 160, 170, 180. As one example, a first part 162, 172, 182 and second part 166, 176, 186 of the gripper 160, 170, 180 may be slid over the respective tools 130, 140 such that the tools 130, 140 are at least partially sheathed in (e.g., enclosed by) the gripper 160, 170, 180. Further, as an example, the gripper 160, 170, 180 may be slid over the respective tools 130, 140 from back to front (e.g., toward the second end 116, 126 of the levers 110, 120), such that the gripper 160, 170, 180 can effectively remain in place when an arrow 200 is being pulled from a target.

In one implementation, the first part 162, 172, 182 of the gripper 160, 170, 180 may be comprised of a thermoplastic elastomer (TPE), such as comprising thermoplastic vulcanizates (TPV). Further, in one implementation, the second part 166, 176, 186 of the gripper 160, 170, 180 may be comprised of a thermoplastic elastomer (TPE), such as comprising thermoplastic vulcanizates (TPV). Additionally, in other implementations, the first part 162, 172, 182, and/or the second part 166, 176, 186, of the gripper 160, 170, 180 may be comprised of polymers, rubber, synthetic rubber, and/or other suitable materials selected with good engineering judgment. As one example, the first part 162, 172, 182, and/or the second part 166, 176, 186, of the gripper 160, 170, 180 may be formed by molding, casting, or otherwise forming the part using a suitable process selected with good engineering judgment.

Figure 7:
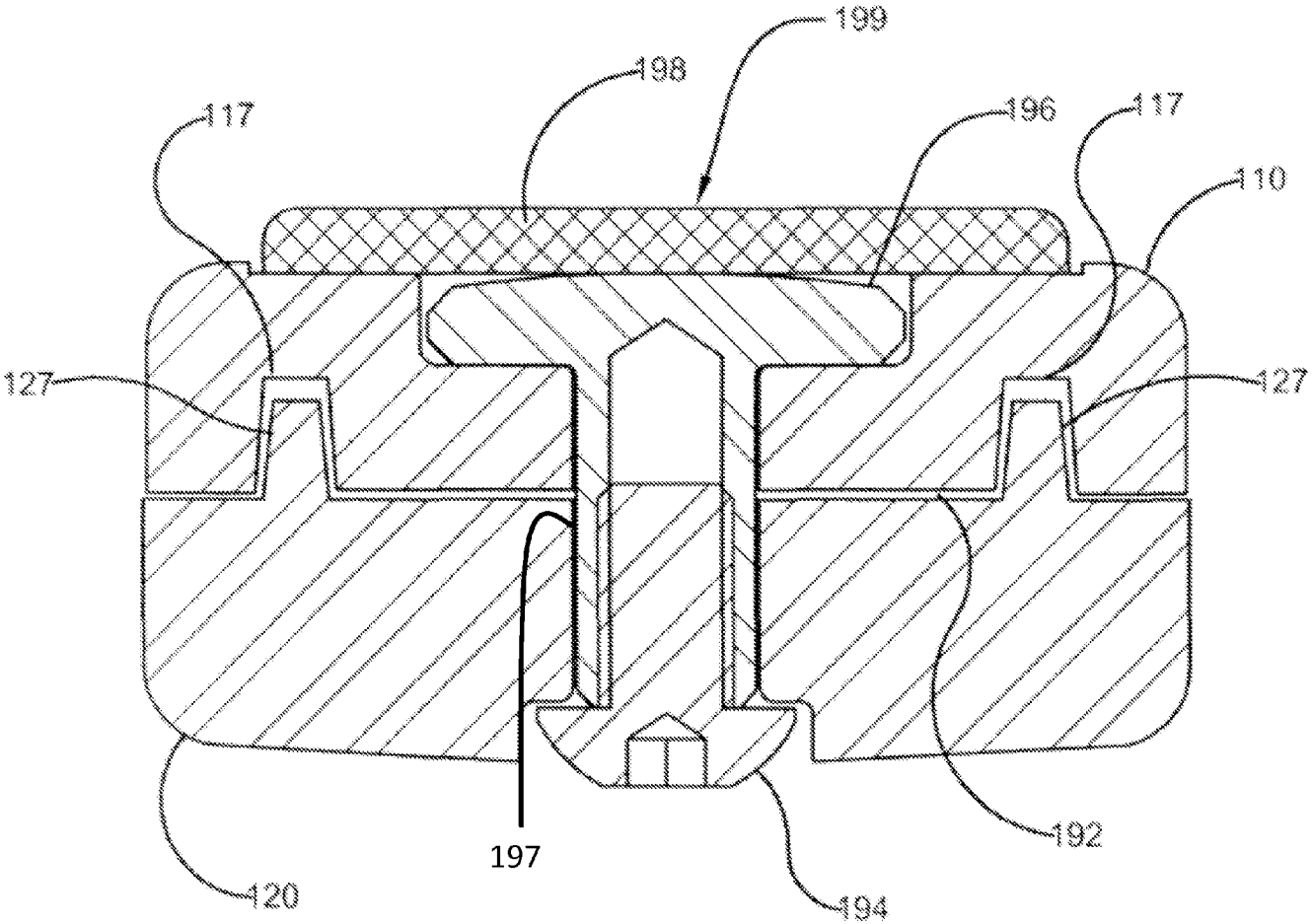
FIG. 7 is a component diagram illustrating a sectional view of an example implementation of an arrow extractor.
Figure 8:
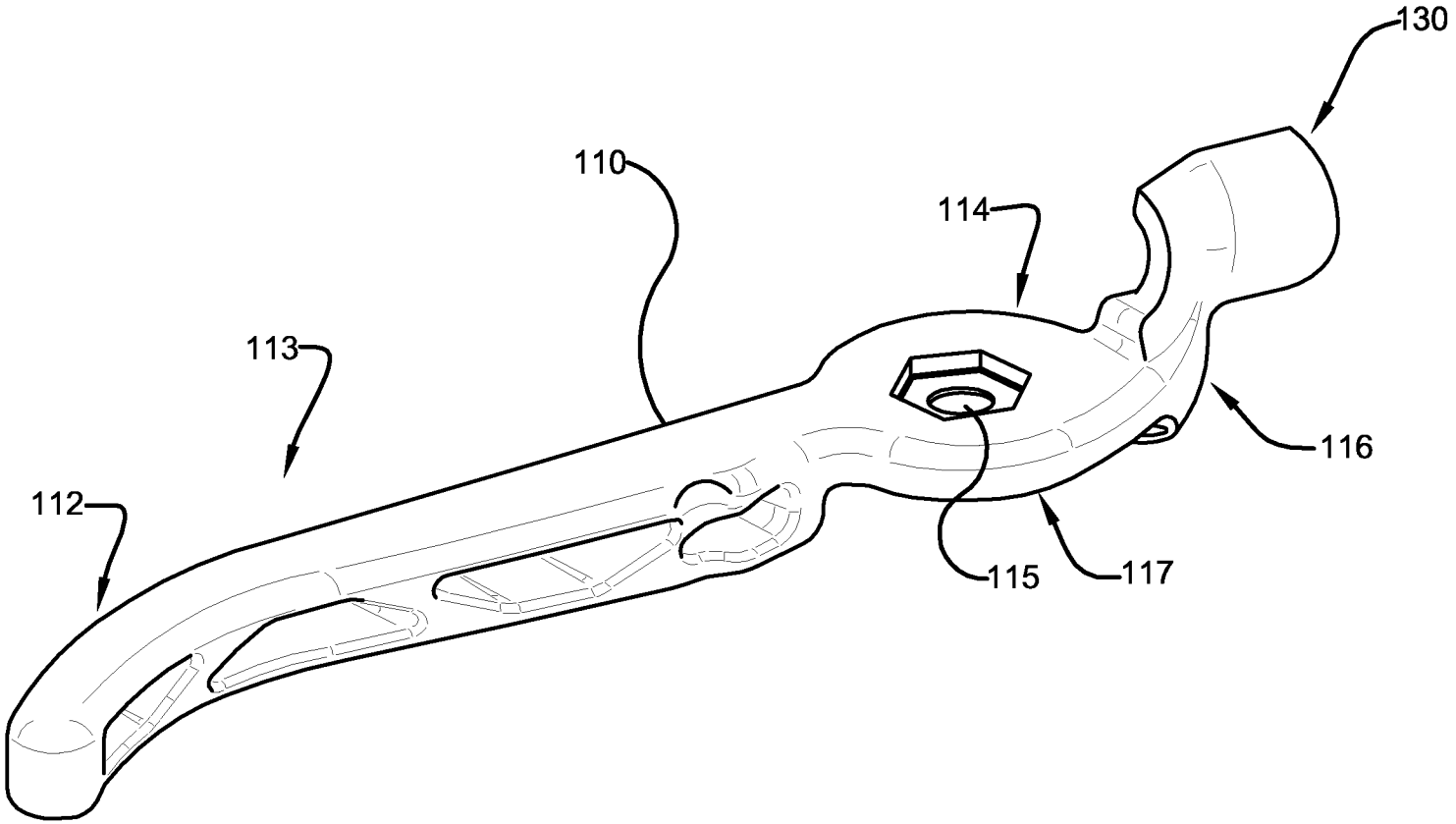
FIG. 8 is a component diagram illustrating a perspective view of an example implementation of an arrow extractor.
Figure 9:
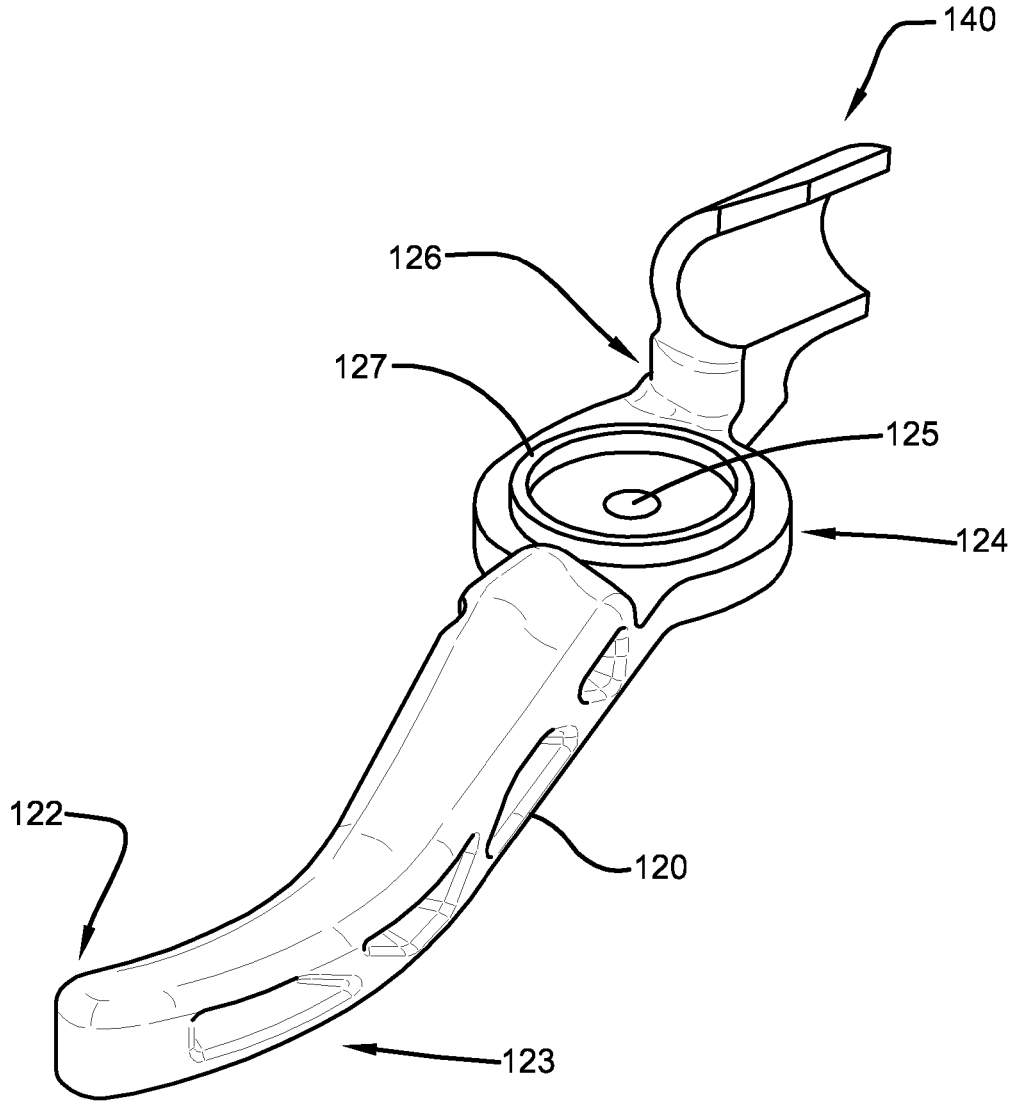
FIG. 9 is a component diagram illustrating a perspective view of an example implementation of an arrow extractor.
Figure 10:
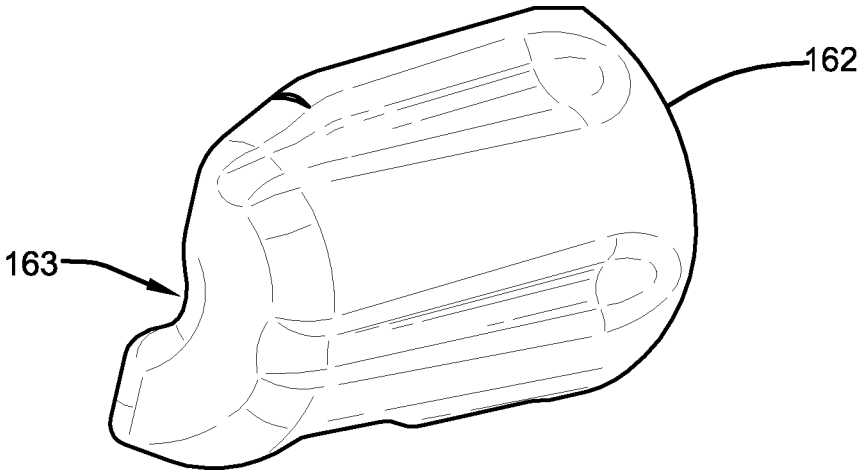
FIG. 10 is a component diagram illustrating a perspective view of an example implementation of an arrow extractor.
Figure 11:
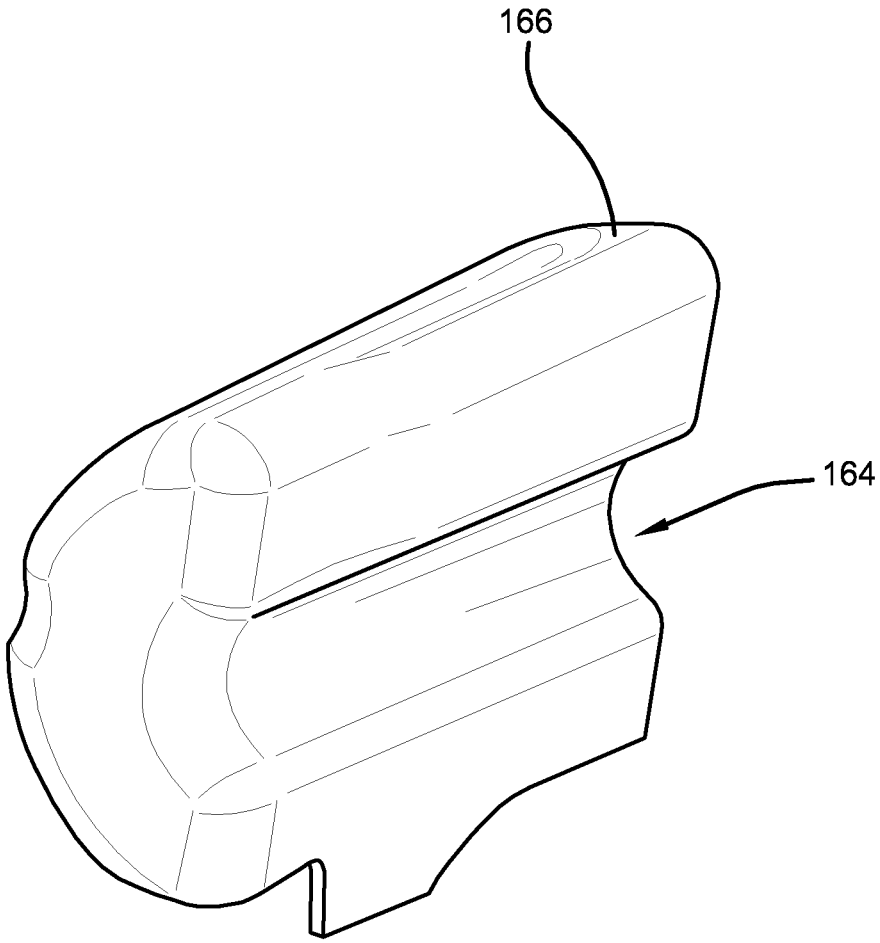
FIG. 11 is a component diagram illustrating a perspective view of an example implementation of an arrow extractor.
Figure 12:
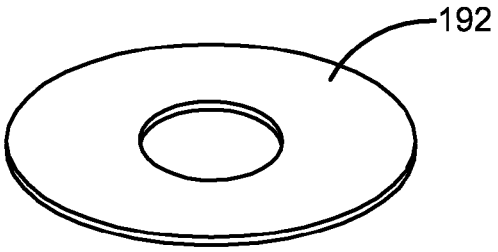
FIG. 12 is a component diagram illustrating a perspective view of an example implementation of an arrow extractor.
Figure 13:
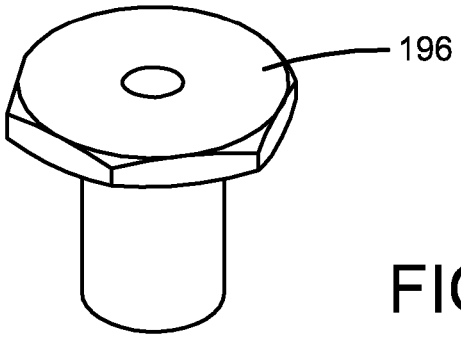
FIG. 13 is a component diagram illustrating a perspective view of an example implementation of an arrow extractor.
Figure 14:
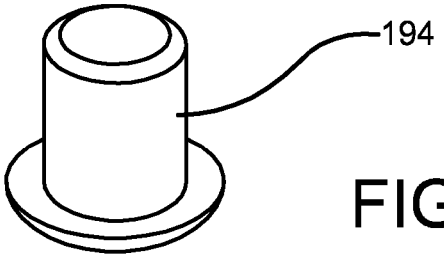
FIG. 14 is a component diagram illustrating a perspective view of an example implementation of an arrow extractor.
Figure 15:
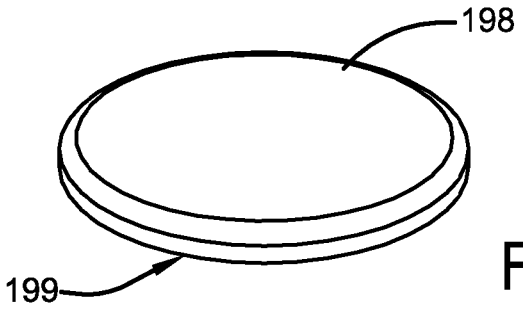
FIG. 15 is a component diagram illustrating a perspective view of an example implementation of an arrow extractor.
Figure 16:
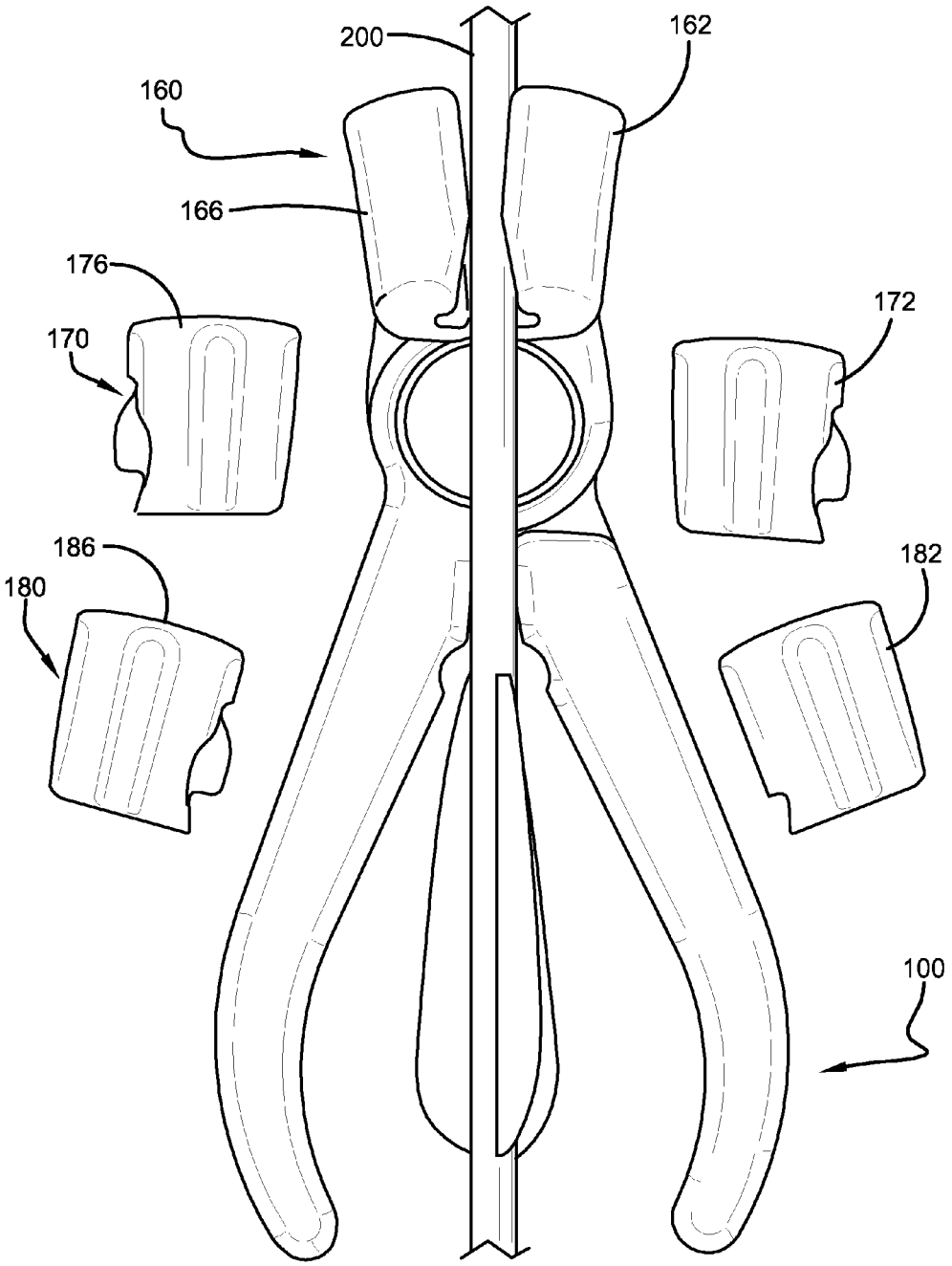
FIG. 16 is a component diagram illustrating an example implementation of an arrow extractor, interchangeable components, and an associated arrow.

In one aspect, there may be a variety of ways in which the first lever 110 and the second lever 120 can be rotatably engaged with each other at their respective rotational engagement regions 114, 124. In one implementation, in this aspect, the first rotational engagement region 114 and the second rotational engagement region 124 can respectively comprise through holes 115, 125 that are configured to accept mechanical components 194, 196. As shown in FIG. 7, mechanical components 194, 196 may comprise a bolt 194 and a sex bolt 196 configured for threaded engagement with each other to form a shaft 197 about which the first lever 110 and the second lever 120 may rotate with respect to one another.

In other implementations, other suitable means for forming a shaft 197 may be used to rotatably engage the respective first 110 and second 120 levers. As one example, a shoulder bolt and nut combination, a pin, a rivet, a boss, and/or other component integrally formed with either the first lever 110 or the second lever 120, could be configured as a shaft 197 about which the first lever 110 and the second lever 120 may rotate with respect to each other. Accordingly, the rotational engagement region 114 and the rotational engagement region 124 may change with the particular implementation and may comprise any or none of a through hole 115, 125, a blind hole (not shown), an annular rib 127, an annular groove 117, or a boss (not shown).

The one implementation, an optional slip plate 192 may be disposed between the first lever 110 and the second lever 120. As one example, the slip plate 192 may be configured to reduce friction between the first lever 110 and the second lever 120 and thereby mitigate forces that may otherwise diminish efficiency. In one implementation, the slip plate 192 may comprise a lubricant, polytetrafluoroethylene (PFTE), or another suitable material chosen with good engineering judgment. In some implementations, one or more parts of the first lever 110 and the second lever 120, such as the first rotational engagement region 114 and/or the second rotational engagement region 124, may comprise (e.g., be impregnated with) a material configured to reduce friction, such as PFTE or a lubricant.

In one implementation, an optional cover plate 198 may be disposed over the rotational engagement regions 114, 124. In one implementation, the cover plate 198 may be configured to shroud the covered regions, thereby mitigating entry of dust, debris, or other material, which may foul the rotational engagement regions 114, 124. As one example, the cover plate 198 may be secured by a snap thread, an adhesive, and/or other suitable means chosen with good engineering judgment. Additionally, for example, the cover plate 198 may comprise a marking 199 such as a logo, trademark, and/or decorative markings.

In one implementation (e.g., FIG. 4), the elongated cavity 161 can define an axis of elongation 136. Further, in this implementation, the rotatable engagement area 190 can define an axis of rotation 138. Additionally, in this implementation, the axis of elongation 136 can be disposed at an angle 150 with respect to the axis of rotation 138, where the angle 150 can be selected from a range of forty-five to ninety degrees. In one implementation the angle 150 between the axis of elongation 136 and the axis of rotation 138 may comprise approximately seventy-five degrees. In this way, for example, a more ergonomic use of the 100 may be applied when grasping and/or extracting arrows from an object. That is, for example, a person may normally grasp the levers 110, 120 at a particular angle, and the embedded arrow shaft may be disposed at another angle. In this example, the angle 150 can be configured to accommodate the combination of the grasping angle and the arrow angle in a more ergonomic way.

In one implementation (e.g., FIG. 2), the first elongated lever 110 can comprise a first cut-out portion 106 and the second elongated lever 120 can comprise a second cut-out portion 108. Further, in this implementation, the first cut-out portion 106 and the second cut-out portion 108 can comprise a nock manipulation tool 104 when the first elongated lever 110 and said second elongated lever 120 are rotatably engaged. That is, for example, the nock manipulation tool 104 can be configured to securely fit a nock of an associated arrow (e.g., 200) between the first cut-out portion 106 and the second cut-out portion 108 when the first elongated lever 110 and said second elongated lever 120 are rotatably engaged and grasping pressure is applied the first ends 112, 122 of the respective levers 110, 120. As one example, the nock manipulation tool 104 may be used to remove, replace, and/or repair arrow nocks.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. An arrow extractor comprising:

a first elongated lever, said first elongated lever comprising, a first end configured to be manipulated by a user, and a second end comprising a first tool, said first tool configured to engage a first part of a gripper, said gripper comprising an elongated cavity configured to grip the shaft of an arrow;

a second elongated lever in rotatable engagement with said first elongated lever, said second elongated lever comprising, a first end configured to be manipulated by said user, and, a second end comprising a second tool, said second tool being configured to engage a second part of said gripper;

wherein said first tool and said second tool are configured to apply a grasping force to said gripper when said user manipulates said first elongated lever with respect to said second elongated lever;

wherein said elongated cavity defines an axis of elongation;

wherein said rotatable engagement defines an axis of rotation; and wherein said axis of elongation is disposed at a fixed angle with respect to said axis of rotation, said fixed angle selected from a range of forty-five to ninety degrees.

2. The arrow extractor of claim 1 wherein said fixed angle is approximately 75 degrees.

3. An arrow extractor comprising:

a first elongated lever, said first elongated lever comprising, a first end configured to be manipulated by a user, and a second end comprising a first tool, said first tool configured to engage a first part of a gripper, said gripper comprising an elongated cavity configured to grip the shaft of an arrow;

a second elongated lever in rotatable engagement with said first elongated lever, said second elongated lever comprising, a first end configured to be manipulated by said user, and a second end comprising a second tool, said second tool being configured to engage a second part of said gripper; and wherein said first tool and said second tool are configured to apply a grasping force to said gripper when said user manipulates said first elongated lever with respect to said second elongated lever;

wherein said first elongated lever further comprises a first cut-out portion;

wherein said second elongated lever further comprises a second cut-out portion; and, wherein said first cut-out portion and said second cut-out portion comprise a nock manipulation tool when said first elongated lever and said second elongated lever are rotatably engaged.

4. The arrow extractor of claim 3 wherein said rotatable engagement between said first elongated lever and said second elongated lever comprises one or more of:

a slip plate configured to mitigate friction between said first elongated lever and said second elongated lever; and a cover plate configured to mitigate entry of undesired material into said rotatable engagement.

5. The arrow extractor of claim 3 wherein:

said first part of said gripper is configured to engage said first tool by sheathing at least a portion of said first tool with said first part of said gripper; and said second part of said gripper is configured to engage said second tool by sheathing at least a portion of said second tool with said second part of said gripper.

6. The arrow extractor of claim 3 wherein one or more of:

said first tool is further configured to selectively engage said first part of said gripper; and said second tool is further configured to selectively engage said second part of said gripper.

7. The arrow extractor of claim 3 wherein said gripper comprises one or more of:

a first gripper comprising a first part configured to be selectively removable from said first tool and a second part configured to be selectively removable from said second tool; and a second gripper comprising a first part configured to be selectively removable from said first tool and a second part configured to be selectively removable from said second tool.

8. The arrow extractor of claim 7, wherein one or more of:

an elongated cavity of said first gripper is configured to grip an arrow shaft comprising a first size; and an elongated cavity of said second gripper is configured to grip an arrow shaft comprising a second size.

9. The arrow extractor of claim 3 wherein one or more of:

said first tool is integral with said first part of said gripper, and said second tool is integral with said second part of said gripper; and said first tool is configured to be selectively removable from said second end of said first elongated lever, and said second tool is configured to be selectively removable from said second end of said second elongated lever.

10. The arrow extractor of claim 3 wherein said elongated cavity of said gripper is configured to be substantially cylindrical.

11. A device for extracting an embedded arrow, comprising:

a first elongated lever, said first elongated lever comprising:

a first end configured to be manipulated by a user, and a second end comprising a first tool, said first tool comprising a first part of a gripper, said gripper comprising an elongated cavity configured to grip the shaft of an arrow;

a second elongated lever in rotatable engagement with said first elongated lever, said second elongated lever comprising:

a first end configured to be manipulated by said user, a second end comprising a second tool, said second tool comprising a second part of said gripper;

wherein said first tool and said second tool are configured to apply a grasping force to said gripper when said user manipulates said first elongated lever with respect to said second elongated lever;

wherein said elongated cavity defines an axis of elongation; rotatable engagement defines an axis of rotation; and wherein said axis of elongation is disposed at a fixed angle with respect to said axis of rotation, said fixed angle selected from a range of forty-five to ninety degrees.

12. The device of claim 11 wherein said fixed angle is approximately 75 degrees.

13. A device for extracting an embedded arrow, comprising:

a first elongated lever, said first elongated lever comprising:

a first end configured to be manipulated by a user, and a second end comprising a first tool, said first tool comprising a first part of a gripper, said gripper comprising an elongated cavity configured to grip the shaft of an arrow;

a second elongated lever in rotatable engagement with said first elongated lever, said second elongated lever comprising:

a first end configured to be manipulated by said user, a second end comprising a second tool, said second tool comprising a second part of said gripper;

wherein said first tool and said second tool are configured to apply a grasping force to said gripper when said user manipulates said first elongated lever with respect to said second elongated lever;

wherein said first elongated lever further comprises a first cut-out portion;

wherein said second elongated lever further comprises a second cut-out portion; and, wherein said first cut-out portion and said second cut-out portion comprise a nock manipulation tool when said first elongated lever and said second elongated lever are rotatably engaged.

14. The device of claim 13, wherein one or more of:

said first part of said gripper is configured to be selectively removable from said first tool; and said second part of said gripper is configured to be selectively removable from said second tool.

15. The device of claim 13, wherein said gripper comprises a third part and a fourth part.

16. The device of claim 15, wherein one or more of:

said third part is configured to be interchangeable with said first part, with respect to said first tool; and said fourth part is configured to be interchangeable with said second part, with respect to said second tool.

17. The device of claim 15, wherein one or more of:

said first part and said second part are configured to grip an arrow shaft comprising a first size; and said third part and said fourth part are configured to grip an arrow shaft comprising a second size.

18. The device of claim 13, wherein said first elongated lever and said second elongated lever are comprised of one or more of:

a long glass fiber (LGF) reinforced thermoplastic;

a polymer;

a polymer mixture; and a metal.

19. The device of claim 13 wherein said gripper is comprised of one or more of:

thermoplastic vulcanizates (TPV);

thermoplastic elastomers (TPE);

rubber;

synthetic rubber; and polymers.

* * * * *